US009828954B2

(12) United States Patent
Majors et al.

(10) Patent No.: US 9,828,954 B2
(45) Date of Patent: Nov. 28, 2017

(54) FUEL CONTROL SYSTEMS AND METHODS FOR PREVENTING OVER FUELING

(71) Applicant: GM Global Technology Operations LLC, Detroit, MI (US)

(72) Inventors: Steven Ward Majors, Howell, MI (US); Scott Jeffrey, Hartland, MI (US); Jason West, Northville, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 84 days.

(21) Appl. No.: 14/840,426

(22) Filed: Aug. 31, 2015

(65) Prior Publication Data

US 2017/0002755 A1 Jan. 5, 2017

Related U.S. Application Data

(60) Provisional application No. 62/186,778, filed on Jun. 30, 2015.

(51) Int. Cl.

| | |
|---|---|
| ***F02D 41/00*** | (2006.01) |
| ***F02M 25/08*** | (2006.01) |
| ***F02D 41/08*** | (2006.01) |
| *F02D 41/14* | (2006.01) |

(52) U.S. Cl.

CPC ..... *F02M 25/089* (2013.01); *F02D 41/0035* (2013.01); *F02D 41/08* (2013.01); *F02D 41/1454* (2013.01); *F02D 41/1487* (2013.01); *F02D 41/1497* (2013.01); *F02M 25/0836* (2013.01); *F02M 25/0854* (2013.01); *F02D 41/1441* (2013.01); *F02D 2200/101* (2013.01); *F02M 25/08* (2013.01)

(58) Field of Classification Search

CPC ..... F02M 25/08; F02M 25/0836; F02M 25/0854; F02M 25/089; F02M 25/05; F02D 41/0032; F02D 41/0042; F02D 41/004; F02D 41/0097

USPC ..... 123/516, 518–520

See application file for complete search history.

(56) References Cited

U.S. PATENT DOCUMENTS

| | | | | |
|---|---|---|---|---|
| 4,630,581 A * | 12/1986 | Shibata | F02D 41/0032 | 123/325 |
| 5,216,991 A * | 6/1993 | Iida | F02D 31/004 | 123/339.23 |
| 6,230,699 B1 * | 5/2001 | Mitsutani | F02D 41/0042 | 123/674 |
| 6,283,088 B1 * | 9/2001 | Takagi | F02B 17/005 | 123/295 |
| 2011/0114062 A1 * | 5/2011 | Wang | F02D 41/003 | 123/406.24 |

* cited by examiner

*Primary Examiner* — Hai Huynh
*Assistant Examiner* — Gonzalo Laguarda

(57) ABSTRACT

A fuel control system for an engine includes a closing module and a purge control module. The closing module commands closing of a purge valve in response an engine speed transitioning from greater than a predetermined speed to less than the predetermined speed while the purge valve is in an open state. The predetermined speed is less than a predetermined target speed of the engine and is greater than zero. The purge control module transitions the purge valve from the open state to a closed state in response to the command.

22 Claims, 6 Drawing Sheets

FUEL CONTROL SYSTEMS AND METHODS FOR PREVENTING OVER FUELING

CROSS-REFERENCE TO RELATED APPLICATIONS

This application claims the benefit of U.S. Provisional Application No. 62/186,778, filed on Jun. 30, 2015. The disclosure of the above application is incorporated herein by reference in its entirety.

FIELD

The present disclosure relates to internal combustion engines and more specifically to fuel control systems and methods.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A fuel control system controls provision of fuel to an engine. The fuel control system includes an inner control loop and an outer control loop. The inner control loop may use data from an exhaust gas oxygen (EGO) sensor located upstream from a catalyst in an exhaust system. The catalyst receives exhaust gas output by the engine.

The inner control loop controls the amount of fuel provided to the engine based on the data from the upstream EGO sensor. For example only, when the upstream EGO sensor indicates that the exhaust gas is (fuel) rich, the inner control loop may decrease the amount of fuel provided to the engine. Conversely, the inner control loop may increase the amount of fuel provided to the engine when the exhaust gas is lean. Adjusting the amount of fuel provided to the engine based on the data from the upstream EGO sensor modulates the air/fuel mixture combusted within the engine at approximately a target air/fuel mixture (e.g., a stoichiometry mixture).

The outer control loop may use data from an EGO sensor located downstream from the catalyst. For example only, the outer control loop may use the response of the upstream and downstream EGO sensors to determine an amount of oxygen stored by the catalyst and other suitable parameters. The outer control loop may also use the response of the downstream EGO sensor to correct the response of the upstream and/or downstream EGO sensors when the downstream EGO sensor provides an unexpected response.

SUMMARY

In a feature, a fuel control system for an engine is described. A closing module commands closing of a purge valve in response an engine speed transitioning from greater than a predetermined speed to less than the predetermined speed while the purge valve is in an open state. The predetermined speed is less than a predetermined target speed of the engine and is greater than zero. A purge control module transitions the purge valve from the open state to a closed state in response to the command.

In further features, the predetermined target speed is a predetermined idle engine speed.

In further features, the predetermined speed is at least five percent less than the predetermined idle engine speed.

In further features, the closing module commands the closing of the purge valve in response to the engine speed transitioning from greater than the predetermined speed to less than the predetermined speed while both (i) the purge valve is in an open state that the purge valve is in the open state and (ii) that an output of an exhaust gas oxygen sensor indicates that an air/fuel mixture supplied to the engine is fuel rich relative to a target air/fuel mixture.

In further features, a fuel control module periodically toggles the target air/fuel mixture between fuel rich and fuel lean and that controls fueling of the engine based on the target air/fuel mixture.

In further features: a closed-loop module sets a closed-loop fuel correction based on an output of an exhaust gas oxygen sensor measuring oxygen in exhaust gas by from the engine and maintains the closed-loop fuel correction when the purge valve is in the open state and the engine speed transitions from greater than the predetermined speed to less than the predetermined speed; and a fuel control module controls fuel injection of the engine based on the closed-loop fuel correction.

In further features, the closed-loop module maintains the closed-loop fuel correction until at least a predetermined mass of air has entered the engine.

In further features, the closed-loop module increases the closed-loop fuel correction toward a predetermined value at a predetermined rate after the maintaining of the closed-loop fuel correction.

In further features, the closed-loop module maintains the closed-loop fuel correction until the output of the exhaust gas oxygen sensor indicates that an air/fuel mixture supplied to the engine is fuel lean relative to a target air/fuel mixture.

In further features, the closed-loop module maintains the closed-loop fuel correction for a predetermined period when the purge valve is in the open state and the engine speed becomes less than the predetermined speed.

In further features: a fuel correction module generates a fueling correction and that selectively increases the fueling correction; and a fuel control module richens fueling of the engine based on the increase in the fueling correction. The fuel correction module sets the fueling correction to a predetermined value when the purge valve is in the open state and the engine speed transitions from greater than the predetermined speed to less than the predetermined speed, and the fuel control module does not richen fueling of the engine based on the fueling correction when the fueling correction is set to the predetermined value.

In a feature, a method of controlling fueling of an engine is described. The method includes: commanding closing of a purge valve in response an engine speed transitioning from greater than a predetermined speed to less than the predetermined speed while the purge valve is in an open state, wherein the predetermined speed is less than a predetermined target speed of the engine and is greater than zero; and transitioning the purge valve from the open state to a closed state in response to the command.

In further features, the predetermined target speed is a predetermined idle engine speed.

In further features, the predetermined speed is at least five percent less than the predetermined idle engine speed.

In further features, the commanding closing of the purge valve comprises commanding the closing of the purge valve in response to the engine speed transitioning from greater than the predetermined speed to less than the predetermined speed while both (i) the purge valve is in an open state that the purge valve is in the open state and (ii) that an output of an exhaust gas oxygen sensor indicates that an air/fuel mixture supplied to the engine is fuel rich relative to a target air/fuel mixture.

In further features, the method further includes: periodically toggling the target air/fuel mixture between fuel rich and fuel lean; and controlling fueling of the engine based on the target air/fuel mixture.

In further features, the method further includes: setting a closed-loop fuel correction based on an output of an exhaust gas oxygen sensor measuring oxygen in exhaust gas by from the engine; maintaining the closed-loop fuel correction when the purge valve is in the open state and the engine speed transitions from greater than the predetermined speed to less than the predetermined speed; and controlling fuel injection of the engine based on the closed-loop fuel correction.

In further features, the maintaining the closed-loop fuel correction comprises maintaining the closed-loop fuel correction until at least a predetermined mass of air has entered the engine.

In further features, the method further includes increasing the closed-loop fuel correction toward a predetermined value at a predetermined rate after the maintaining of the closed-loop fuel correction.

In further features, the maintaining the closed-loop fuel correction comprises maintaining the closed-loop fuel correction until the output of the exhaust gas oxygen sensor indicates that an air/fuel mixture supplied to the engine is fuel lean relative to a target air/fuel mixture.

In further features, the maintaining the closed-loop fuel correction comprises maintaining the closed-loop fuel correction for a predetermined period when the purge valve is in the open state and the engine speed becomes less than the predetermined speed.

In further features, the method further includes: generating a fueling correction; selectively increasing the fueling correction; richening fueling of the engine based on the increase in the fueling correction; setting the fueling correction to a predetermined value when the purge valve is in the open state and the engine speed transitions from greater than the predetermined speed to less than the predetermined speed; and not richening fueling of the engine based on the fueling correction when the fueling correction is set to the predetermined value.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

An engine combusts a mixture of air and fuel to produce torque. Fuel injectors may inject liquid fuel drawn from a fuel tank. Some conditions, such as heat, radiation, and fuel type may cause fuel to vaporize within the fuel tank. A vapor canister traps fuel vapor, and the fuel vapor may be drawn from the vapor canister through a purge valve to the engine. The engine expels exhaust to an exhaust system.

An exhaust gas oxygen (EGO) sensor measures an amount of oxygen in the exhaust upstream of a catalyst. EGO sensors may also be referred to as air/fuel sensors. Wide range air/fuel (WRAF) sensors and universal EGO (UEGO) sensors measure values between values indicative of rich and lean operation, while switching EGO and switching air/fuel sensors toggle between the values indicative of rich and lean operation.

An engine control module (ECM) controls fuel injection and other engine actuators. Over fueling may occur under some circumstances, such as when the purge valve is open and fuel vapor is flowing to the engine. Over fueling at engine idle causes an engine speed to decrease and may even cause the engine to stall. Over fueling when the purge valve is open may be attributable to, for example, fuel vapor flow through the purge valve.

The ECM of the present disclosure monitors the engine speed and whether the purge valve is open. When the purge valve is open and the engine speed falls below a target engine speed, such as a target idle speed, the ECM closes the purge valve. This prevents fuel vapor flow to the engine and decreases overall fueling of the engine, thereby allowing the engine speed to increase.

Figure 1:
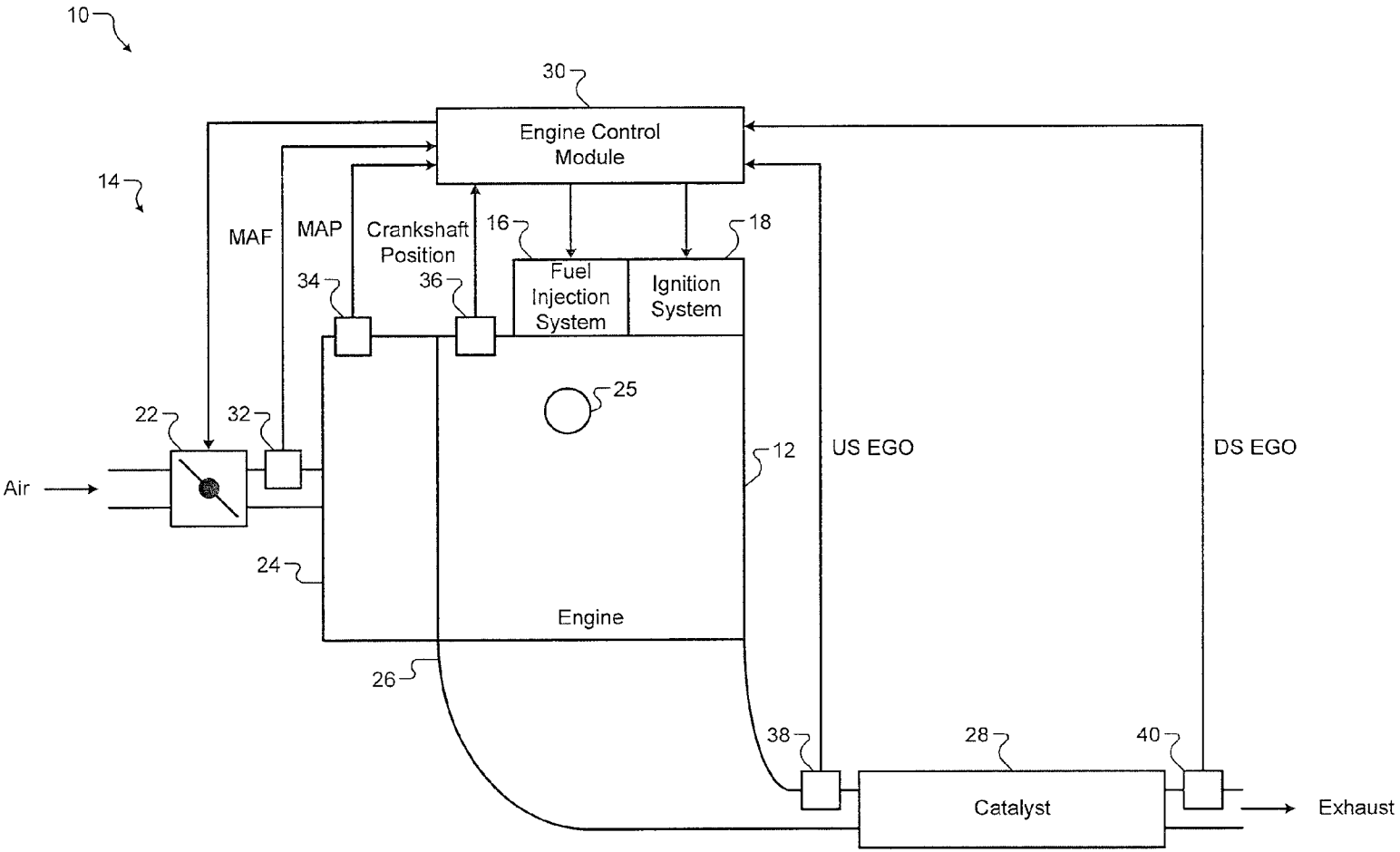
FIG. 1 is a functional block diagram of an example engine system.

Referring now to FIG. 1, a functional block diagram of an example engine system 10 is presented. The engine system 10 includes an engine 12, an intake system 14, a fuel injection system 16, an ignition system 18, and an exhaust system 20. While the engine system 10 is shown and will be described in terms of a gasoline engine, the present application is applicable to hybrid engine systems and other suitable types of engine systems having a fuel vapor purge system.

The intake system 14 may include a throttle 22 and an intake manifold 24. The throttle 22 controls air flow into the intake manifold 24. Air flows from the intake manifold 24 into one or more cylinders within the engine 12, such as cylinder 25. While only the cylinder 25 is shown, the engine 12 may include more than one cylinder. The fuel injection system 16 includes a plurality of fuel injectors and controls (liquid) fuel injection for the engine 12. As discussed further below (e.g., see FIG. 2), fuel vapor is also selectively provided to the engine 12 via the intake system 14.

Exhaust resulting from combustion of the air/fuel mixture is expelled from the engine 12 to the exhaust system 20. The exhaust system 20 includes an exhaust manifold 26 and a catalyst 28. For example only, the catalyst 28 may include a three way catalyst (TWC) and/or another suitable type of catalyst. The catalyst 28 receives the exhaust output by the engine 12 and reacts with various components of the exhaust.

The engine system 10 also includes an engine control module (ECM) 30 that regulates operation of the engine system 10. The ECM 30 communicates with the intake system 14, the fuel injection system 16, and the ignition system 18. The ECM 30 also communicates with various sensors. For example only, the ECM 30 may communicate with a mass air flow (MAF) sensor 32, a manifold air pressure (MAP) sensor 34, a crankshaft position sensor 36, and other suitable sensors.

The MAF sensor 32 measures a mass flowrate of air flowing into the intake manifold 24 and generates a MAF signal based on the mass flowrate. The MAP sensor 34 measures pressure within the intake manifold 24 and generates a MAP signal based on the pressure. In some implementations, vacuum within the intake manifold 24 may be measured relative to ambient pressure.

The crankshaft position sensor 36 monitors rotation of a crankshaft (not shown) of the engine 12 and generates a crankshaft position signal based on the rotation of the crankshaft. The crankshaft position signal may be used to determine an engine speed (e.g., in revolutions per minute). The crankshaft position signal may also be used for cylinder identification and one or more other suitable purposes.

The ECM 30 also communicates with exhaust gas oxygen (EGO) sensors associated with the exhaust system 20. For example only, the ECM 30 communicates with an upstream EGO sensor (US EGO sensor) 38 and a downstream EGO sensor (DS EGO sensor) 40. The US EGO sensor 38 is located upstream of the catalyst 28, and the DS EGO sensor 40 is located downstream of the catalyst 28. The US EGO sensor 38 may be located, for example, at a confluence point of exhaust runners (not shown) of the exhaust manifold 26 or at another suitable location.

The US and DS EGO sensors 38 and 40 measure amounts of oxygen in the exhaust at their respective locations and generate EGO signals based on the amounts of oxygen. For example only, the US EGO sensor 38 generates an upstream EGO (US EGO) signal based on the amount of oxygen upstream of the catalyst 28. The DS EGO sensor 40 generates a downstream EGO (DS EGO) signal based on the amount of oxygen downstream of the catalyst 28.

The US and DS EGO sensors 38 and 40 may each include a switching EGO sensor, a universal EGO (UEGO) sensor (also referred to as a wide band or wide range EGO sensor), or another suitable type of EGO sensor. A switching EGO sensor generates an EGO signal in units of voltage, and switches the EGO signal between a low voltage (e.g., approximately 0.1 V) and a high voltage (e.g., approximately 0.8 V) when the oxygen concentration is lean and rich, respectively. A UEGO sensor generates an EGO signal that corresponds to an equivalence ratio (EQR) of the exhaust gas and provides measurements between rich and lean.

Figure 2:
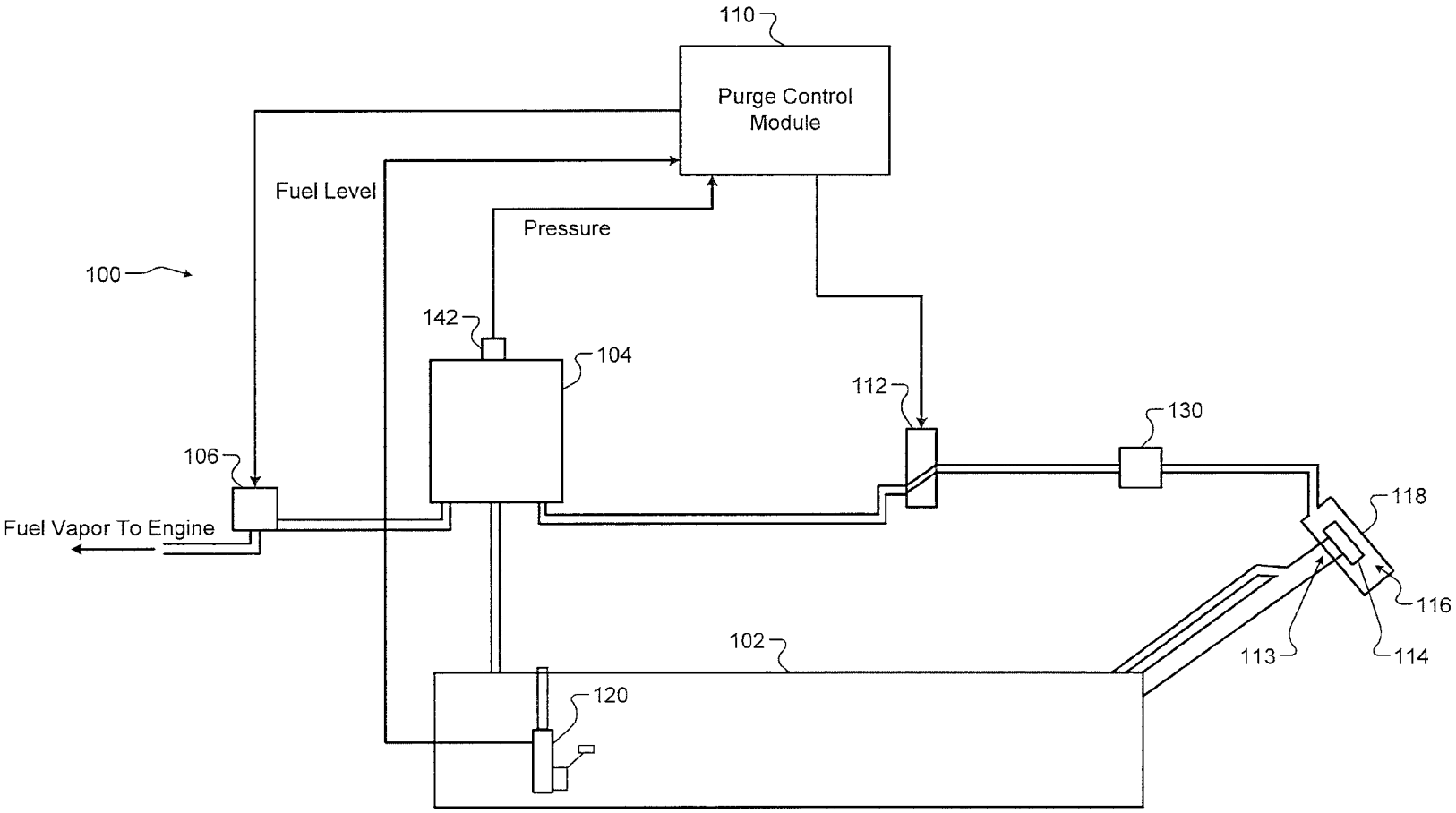
FIG. 2 is a functional block diagram of an example fuel control system.

Referring now to FIG. 2, a functional block diagram of an example fuel control system is presented. A fuel system 100 supplies liquid fuel and fuel vapor to the engine 12. The fuel system 100 includes a fuel tank 102 that contains liquid fuel. Liquid fuel is drawn from the fuel tank 102 and supplied to the fuel injectors by one or more fuel pumps (not shown).

Some conditions, such as heat, vibration, and/or radiation, may cause liquid fuel within the fuel tank 102 to vaporize. A vapor canister 104 traps and stores vaporized fuel (fuel vapor). The vapor canister 104 may include one or more substances that trap and store fuel vapor, such as one or more types of charcoal.

Operation of the engine 12 creates a vacuum within the intake manifold 24. A purge valve 106 may be selectively opened to draw fuel vapor from the vapor canister 104 to the intake manifold 24. A purge control module 110 controls the purge valve 106 to control the flow of fuel vapor to the engine 12. While the purge control module 110 and the ECM 30 are shown and discussed as being independent modules, the ECM 30 may include the purge control module 110.

The purge control module 110 also controls a switching (vent) valve 112. When the switching valve 112 is in a vent position, the purge control module 110 may selectively open the purge valve 106 to purge fuel vapor from the vapor canister 104 to the intake manifold 24. More specifically, the vacuum within the intake manifold 24 draws fuel vapor from the vapor canister 104 through the purge valve 106 to the intake manifold 24. Ambient air is drawn into the vapor canister 104 through the switching valve 112 as fuel vapor is drawn from the vapor canister 104. The purge control module 110 controls fuel vapor purging from the vapor canister 104 (a purge rate) by controlling opening and closing of the purge valve 106. In various implementations, such as boosted engines where vacuum within the intake manifold 24 may be low, a pump may be implemented to pump air to the vapor canister 104.

A driver of the vehicle may add liquid fuel to the fuel tank 102 via a fuel inlet 113. A fuel cap 114 seals the fuel inlet 113. The fuel cap 114 and the fuel inlet 113 may be accessed via a fueling compartment 116. A fuel door 118 may be implemented to shield and close the fueling compartment 116.

A fuel level sensor 120 measures an amount of liquid fuel within the fuel tank 102. The fuel level sensor 120 generates a fuel level signal based on the amount of liquid fuel within the fuel tank 102. For example only, the amount of liquid fuel in the fuel tank 102 may be expressed as a volume, a percentage of a maximum volume of the fuel tank 102, or another suitable measure of the amount of fuel in the fuel tank 102.

The ambient air provided to the vapor canister 104 through the switching valve 112 may be drawn from the fueling compartment 116 in some implementations. A filter 130 receives the ambient air and filters various particulate from the ambient air. A tank pressure sensor 142 measures a pressure within the fuel tank 102. The tank pressure sensor 142 generates a tank pressure signal based on the pressure within the fuel tank 102.

Figure 3:
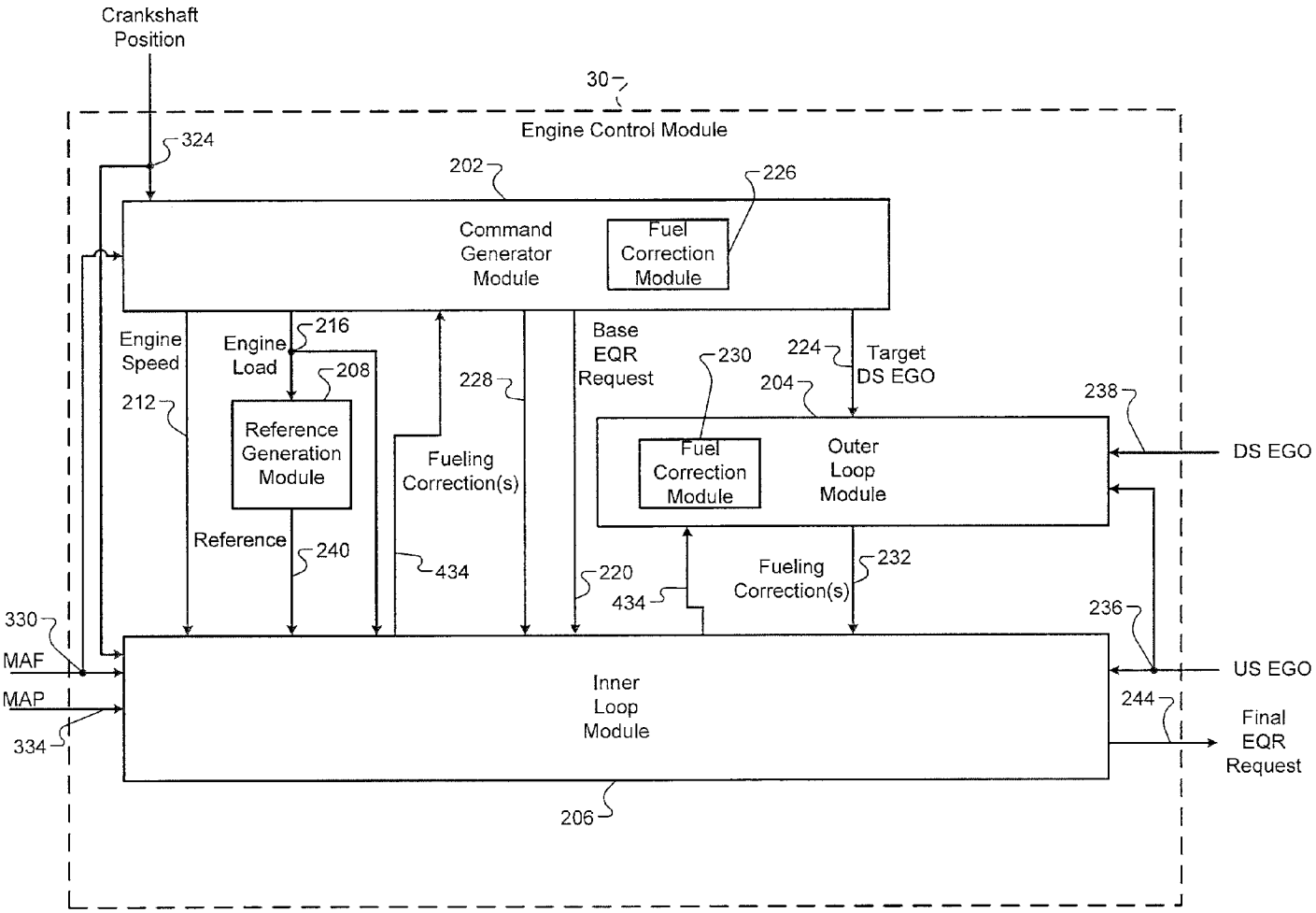
FIG. 3 is a functional block diagram of an example engine control module.

Referring now to FIG. 3, a functional block diagram of a portion of an example implementation of the ECM 30 is presented. The ECM 30 may include a command generator module 202, an outer loop module 204, an inner loop module 206, and a reference generation module 208.

The command generator module 202 may determine one or more engine operating conditions. For example only, the engine operating conditions may include, but are not limited to, engine speed 212, air per cylinder (APC), engine load 216, and/or other suitable parameters. The APC may be predicted for one or more future combustion events in some engine systems. The engine load 216 may be determined based on, for example, a ratio of the APC to a maximum APC of the engine 12. The engine load 216 may alternatively be determined based on an indicated mean effective pressure (IMEP), engine torque, or another suitable parameter indicative of engine load.

The command generator module 202 generates a base equivalence ratio (EQR) request 220. The base EQR request 220 may be generated, for example, based on an APC and to achieve a target equivalence ratio (EQR) of the air/fuel mixture. For example only, the target EQR may include a stoichiometric EQR (i.e., 1.0). The command generator module 202 also determines a target downstream exhaust gas output (a target DS EGO) 224. The command generator module 202 may determine the target DS EGO 224 based on, for example, one or more of the engine operating conditions.

The command generator module 202 may include a first fuel correction module 226 that may generate one or more open-loop fueling corrections 228 for the base EQR request 220. The open-loop fueling corrections 228 may include, for example, a sensor correction and an error correction. For example only, the sensor correction may correspond to a correction to the base EQR request 220 to accommodate the measurements of the US EGO sensor 38. The error correction may correspond to a correction in the base EQR request 220 to account for errors that may occur, such as errors in the determination of the APC and errors attributable to fuel vapor purging.

The outer loop module 204 may include a second fuel correction module 230 that generates one or more open-loop fueling corrections 232 for the base EQR request 220. The second fuel correction module 230 may generate, for example, an oxygen storage correction and an oxygen storage maintenance correction. For example only, the oxygen storage correction may correspond to a correction in the base EQR request 220 to adjust the oxygen storage of the catalyst 28 to a target oxygen storage within a predetermined period. The oxygen storage maintenance correction may correspond to a correction in the base EQR request 220 to modulate the oxygen storage of the catalyst 28 at approximately the target oxygen storage.

The outer loop module 204 may estimate the oxygen storage of the catalyst 28 based on the US EGO signal 236 (generated by the US EGO sensor 38) and the DS EGO signal 238 (generated by the DS EGO sensor 40). The second fuel correction module 230 may generate the open-loop fueling corrections 232 to adjust the oxygen storage of the catalyst 28 to the target oxygen storage and/or to maintain the oxygen storage at approximately the target oxygen storage. The second fuel correction module 230 may also generate the open-loop fueling corrections 232 to minimize a difference between the DS EGO signal 238 and the target DS EGO 224.

The inner loop module 206 (see also FIG. 4) determines an upstream EGO error based on a difference between the US EGO signal 236 and an expected US EGO. The US EGO error may correspond to, for example, a correction in the base EQR request 220 to minimize the difference between the US EGO signal 236 and the expected US EGO. The inner loop module 206 normalizes the US EGO error to produce a closed-loop (CL) fueling correction 250 (see FIG. 4) and selectively adjusts the base EQR request 220 based on the CL correction 250.

The inner loop module 206 also determines an imbalance (fueling) correction for the cylinder 25. The inner loop module 206 determines an imbalance correction for each of the cylinders. The imbalance corrections may also be referred to as individual cylinder fuel correction (ICFCs) or fueling corrections. The imbalance correction for a cylinder may correspond to, for example, a correction in the base EQR request 220 to balance an output of the cylinder with output of the other cylinders.

The reference generation module 208 generates a reference signal 240. For example only, the reference signal 240 may include a sinusoidal wave, triangular wave, or another suitable type of periodic signal. The reference generation module 208 may selectively vary the amplitude and frequency of the reference signal 240. For example only, the reference generation module 208 may increase the frequency and amplitude as the engine load 216 increases and vice versa. The reference signal 240 may be provided to the inner loop module 206 and one or more other modules.

The reference signal 240 may be used in determining a final EQR request 244 to toggle the EQR of the exhaust gas provided to the catalyst 28 back and forth between a predetermined rich EQR and a predetermined lean EQR. For example only, the predetermined rich EQR may be approximately 3 percent rich (e.g., an EQR of 1.03), and the predetermined lean EQR may be approximately 3 percent lean (e.g., an EQR of approximately 0.97). Toggling the EQR may improve the efficiency of the catalyst 28. Additionally, toggling the EQR may be useful in diagnosing faults in the US EGO sensor 38, the catalyst 28, and/or the DS EGO sensor 40.

The inner loop module 206 determines the final EQR request 244 based on the base EQR request 220 and the CL correction. The inner loop module 206 determines the final EQR request 244 further based on the sensor correction, the error correction, the oxygen storage correction, and the oxygen storage maintenance correction, the reference signal 240, and the imbalance correction for the cylinder 25. The ECM 30 controls the fuel injection system 16 based on the final EQR request 244. For example only, the ECM 30 may control the fuel injection system 16 using pulse width modulation (PWM).

Figure 4:
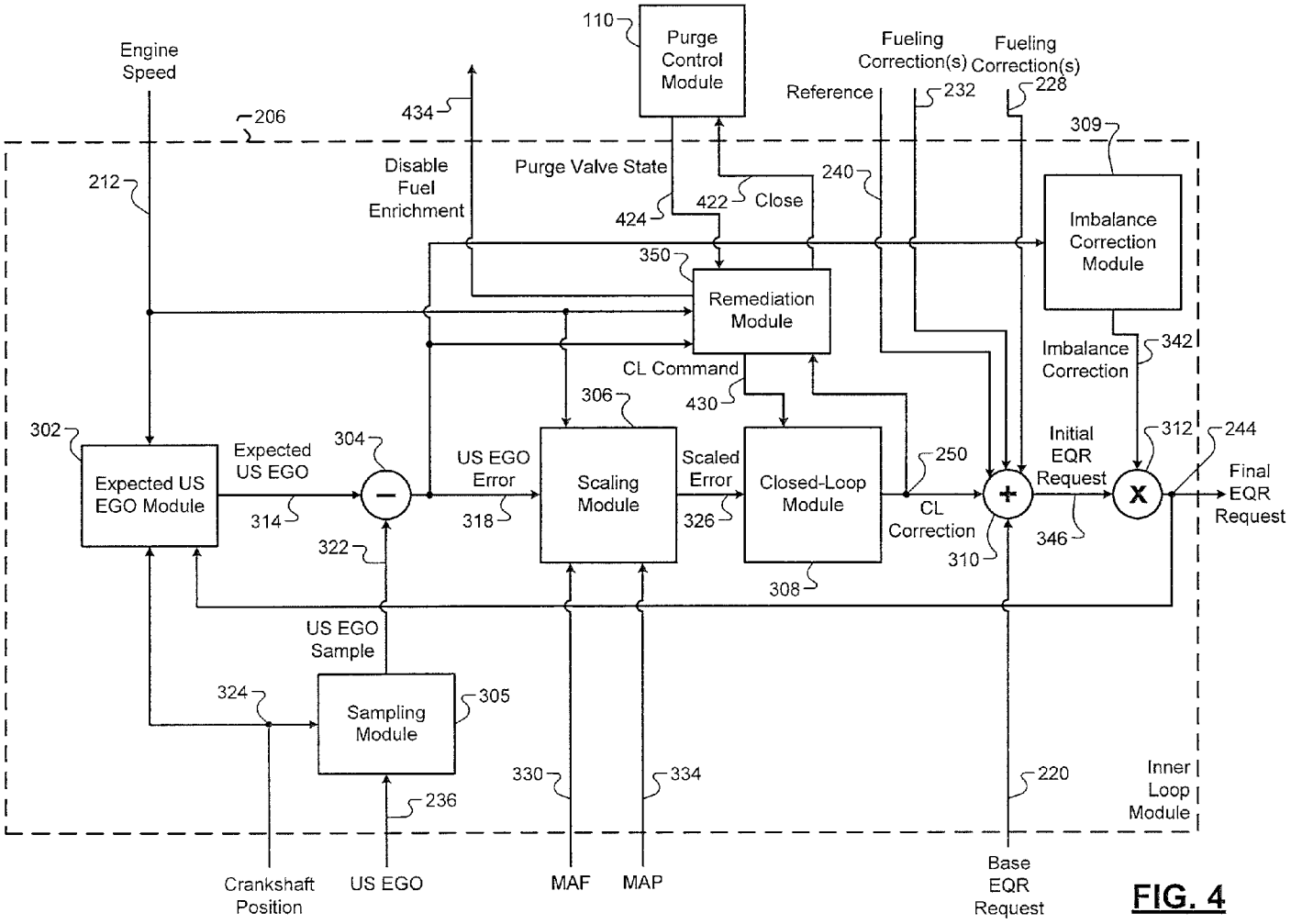
FIG. 4 is a functional block diagram of an example inner loop module.

Referring now to FIG. 4, a functional block diagram of an example implementation of the inner loop module 206 is presented. The inner loop module 206 may include an expected US EGO module 302, an error module 304, a sampling module 305, a scaling module 306, and a closed-loop module 308. The inner loop module 206 may also include an imbalance correction module 309, an initial EQR module 310, and a fuel control module 312.

The expected US EGO module 302 determines the expected US EGO 314. In implementations where the US EGO sensor 38 is a WRAF sensor or a UEGO sensor, the expected US EGO module 302 determines the expected US EGO 314 based on the final EQR request 244. The expected US EGO 314 corresponds to an expected value of a given sample of the US EGO signal 236. However, delays of the engine system 10 prevent the exhaust gas resulting from combustion from being immediately reflected in the US EGO signal 236. The delays of the engine system 10 may include, for example, an engine delay, a transport delay, and a sensor delay.

The engine delay may correspond to a period between, for example, when fuel is provided to a cylinder of the engine 12 and when the resulting exhaust is expelled from the cylinder. The transport delay may correspond to a period between when the resulting exhaust is expelled from the cylinder and when the resulting exhaust reaches the location of the US EGO sensor 38. The sensor delay may correspond to the delay between when the resulting exhaust reaches the location of the US EGO sensor 38 and when the resulting exhaust is reflected in the US EGO signal 236.

The US EGO signal 236 may also reflect a mixture of the exhaust produced by different cylinders of the engine 12. The expected US EGO module 302 accounts for exhaust mixing and the engine, transport, and sensor delays in determining the expected US EGO 314. The expected US EGO module 302 stores the EQR of the final EQR request 244. The expected US EGO module 302 determines the expected US EGO 314 based on one or more stored EQRs, exhaust mixing, and the engine, transport, and sensor delays.

The error module 304 determines an upstream EGO error (US EGO error) 318 based on a sample of the US EGO signal (a US EGO sample) 322 taken at a given sampling time and the expected US EGO 314 for the given sampling time. More specifically, the error module 304 determines the US EGO error 318 based on a difference between the US EGO sample 322 and the expected US EGO 314.

The sampling module 305 selectively samples the US EGO signal 236 and provides the samples to the error module 304. The sampling module 305 may sample the US EGO signal 236 at a predetermined rate, such as once per predetermined number of crankshaft angle degrees (CAD) as indicated by a crankshaft position 324 measured using the crankshaft position sensor 36. The predetermined rate may be set, for example, based on the number of cylinders of the engine 12, the number of EGO sensors implemented, the firing order of the cylinders, and a configuration of the engine 12. For example only, for a four cylinder engine with one cylinder bank and one EGO sensor, the predetermined rate may be approximately eight CAD based samples per engine cycle or another suitable rate.

The scaling module 306 determines a scaled error 326 based on the US EGO error 318. The scaling module 306 may apply one or more gains or other suitable control factors in determining the scaled error 326 based on the US EGO error 318. For example only, the scaling module 306 may determine the scaled error 326 using the equation:

$$\text{Scaled Error} = \frac{MAF}{14.7} * US\ EGO\ \text{Error}, \tag{1}$$

where Scaled Error is the scaled error 326, MAF is a MAF 330 measured using the MAF sensor 32, and US EGO Error is the US EGO error 318. Alternatively, the scaling module 306 may determine the scaled error 326 based on:

$$\text{Scaled Error} = k(\text{MAP,RPM}) * \text{US EGO Error}, \tag{2}$$

where RPM is the engine speed 212, MAP is a MAP 334 measured using the MAP sensor 34, k is a function of the MAP 334 and the engine speed 212, and US EGO Error is the US EGO error 318. In some implementations, k may be additionally or alternatively be a function of the engine load 216.

The closed-loop module 308 determines the CL correction 250 based on the scaled error 326. For example only, the closed-loop module 308 may include a proportional-integral (PI) controller, a proportional (P) controller, an integral (I) controller, or a proportional-integral-derivative (PID) controller that determines the CL correction 250 based on the scaled error 326.

In implementations involving a switching air/fuel sensor or a switching EGO sensor, the expected US EGO 314 may be set to the current commanded fueling state (i.e., the predetermined rich state or the predetermined lean state). The closed-loop module 308 determines the CL correction 250 based on a period that the US EGO signal 236 (or the samples) is different than the expected US EGO 314. In this manner, the CL correction 250 is determined based on the period that the US EGO sensor 38 indicates the previous commanded fueling state after a transition from the previous commanded fueling state to the current commanded fueling state.

The imbalance correction module 309 monitors the US EGO samples 322 of the US EGO signal 236. The imbalance correction module 309 determines imbalance values for the cylinders of the engine 12 based on the (present) US EGO sample 322 and an average of a predetermined number of previous US EGO samples 322. The imbalance correction module 309 determines an offset value that relates (associates) one of the imbalance values to (with) one of the cylinders of the engine 12. The imbalance correction module 309 correlates the other cylinders of the engine with the other imbalance values, respectively, based on the firing order of the cylinders. The imbalance correction module 309 determines imbalance (fueling) corrections for the cylinders of the engine 12 based on the imbalance values associated with the cylinders, respectively. For example, the imbalance correction module 309 may determine an imbalance correction 342 for the cylinder 25 based on the imbalance value associated with the cylinder 25.

The initial EQR module 310 determines an initial EQR request 346 based on the base EQR request 220, the reference signal 240, the CL correction 250, and the open-loop fueling correction(s) 228 and 232. For example only, the initial EQR module 310 may determine the initial EQR request 346 based on the sum of the base EQR request 220, the reference signal 240, the CL correction 250, and the open-loop fueling correction(s) 228 and 232.

The fuel control module 312 determines the final EQR request 244 based on the initial EQR request 346 and the imbalance correction 342. More specifically, the fuel control module 312 corrects the initial EQR request 346 based on the imbalance correction 342 that is associated with the next cylinder in the firing order. The fuel control module 312 may, for example, set the final EQR request 244 equal to a product of the initial EQR request 346 and the imbalance correction 342 or to a sum of the initial EQR request 346 and the imbalance correction 342. The fuel control module 312 controls the fuel injection system 16 for fuel injection of the next cylinder in the firing order based on the final EQR request 244.

A remediation module 350 takes remedial action when over fueling of the engine 12 occurs due to fuel vapor from the purge valve 106. More specifically, the remediation module 350 takes remedial action when the engine speed 212 falls below a predetermined speed while the purge valve 106 is open. The remedial action includes closing the purge valve 106 and may include one or more other actions, such as disabling one of more fueling enrichments and/or controlling adjustments of the CL correction 250.

Figure 5:
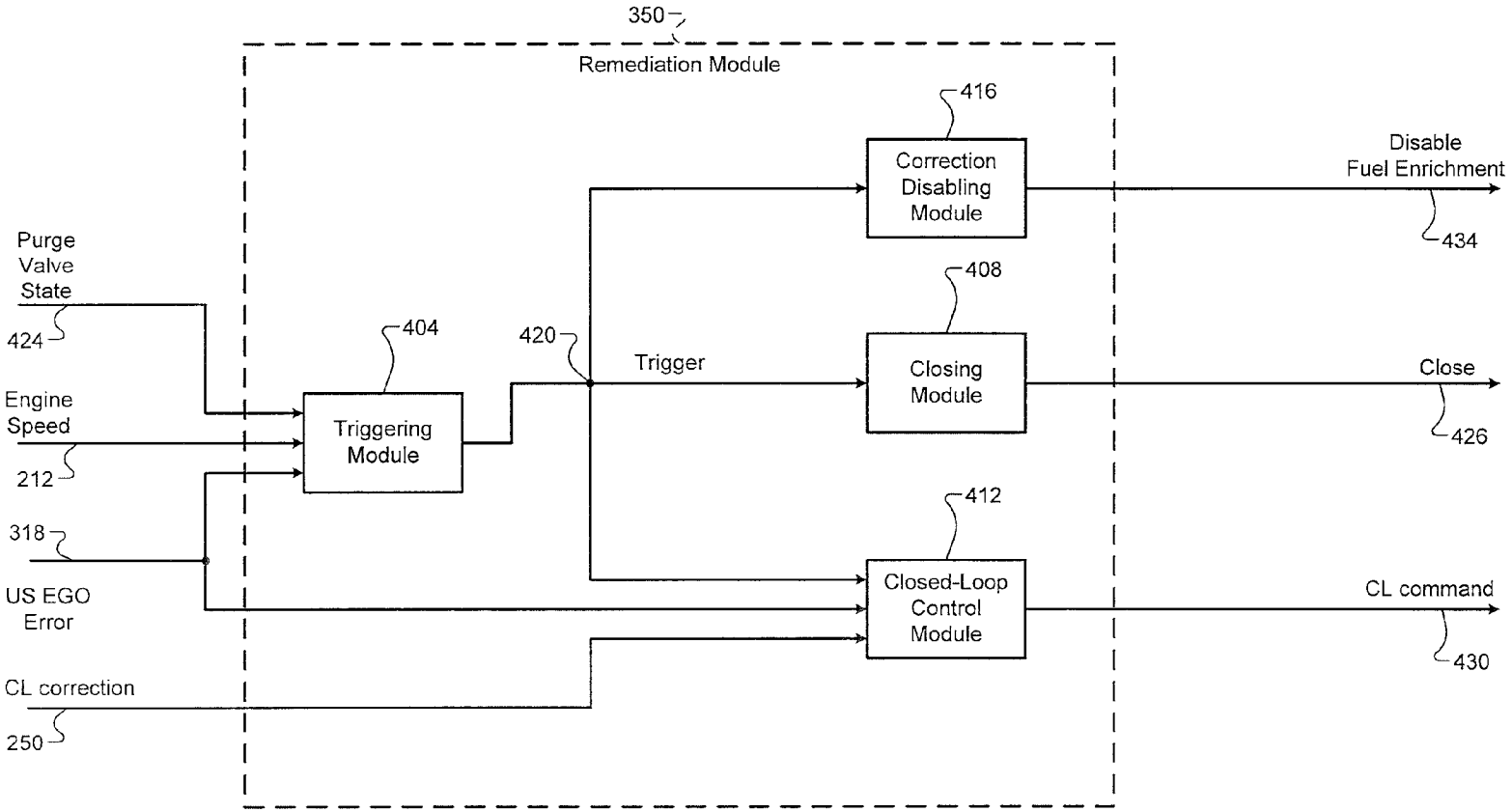
FIG. 5 is a functional block diagram of an example remediation module.

FIG. 5 is a functional block diagram of the remediation module 350. The remediation module 350 includes a triggering module 404, a closing module 408, a closed-loop control module 412, and a correction disabling module 416.

The triggering module 404 generates a trigger signal 420 when the engine speed 212 is less than a predetermined speed and the purge valve 106 is in an open state. The predetermined speed is less than a predetermined idle speed of the engine 12. For example, the predetermined speed may be at least 5 percent less than the predetermined idle speed, at least 10 percent less than the predetermined idle speed, or at least 20 percent less than the predetermined idle speed. In various implementations, the predetermined speed may be set to 30 percent less than the predetermined idle speed. The predetermined idle speed may be, for example, approximately 600-800 revolutions per minute in some types of engines.

The purge control module 110 may indicate whether the purge valve 106 is in an open state or a closed state via a purge valve state 424. For example, the purge control module 110 may set the purge valve state 424 to indicate that the purge valve 106 is in the open state when the duty cycle of the signal applied to the purge valve 106 is greater than zero percent or when the purge valve 106 is at least partially open (i.e., not fully closed). The purge valve 106 allows fuel vapor to flow from the vapor canister 104 to the engine 12 when the purge valve 106 is in the open state. The purge control module 110 may set the purge valve state 424 to indicate that the purge valve 106 is in the closed state when the duty cycle for the signal applied to the purge valve 106 is zero percent or when the purge valve 106 is fully closed. The purge valve 106 prevents fuel vapor flow through the purge valve 106 in the closed state.

To generate the trigger signal 420, the triggering module 404 may also require that the US EGO sensor 38 be indicating that fueling of the engine 12 is fuel rich. In other words, the triggering module 404 may generate the trigger signal 420 when the engine speed 212 is less than the predetermined speed, the purge valve 106 is in the open state, and the US EGO sensor 38 indicates that fueling of the engine 12 is fuel rich. The US EGO error 318 may be used to indicate whether fueling of the engine 12 is fuel rich. For example, fueling of the engine 12 may be fuel rich when a polarity of the US EGO error 318 indicates that the US EGO sample 322 is less than (i.e., more fuel rich than) the expected US EGO 314 or when the US EGO sample 322 indicates less oxygen than stoichiometry. The triggering module 404 may refrain from generating the trigger signal 420 when at least one of: the engine speed 212 is greater than the predetermined speed; the purge valve 106 is in the closed state; and fueling of the engine is not fuel rich.

The closing module 408 generates a close command 426 to command the purge control module 110 to transition the purge valve 106 to the closed state when the trigger signal 420 is generated. The purge control module 110 transitions the purge valve 106 to the closed state in response to the close command 426. The purge valve 106 prevents fuel vapor flow from the vapor canister 104 to the engine 12 when the purge valve 106 is in the closed state. Closing the purge valve 106 prevents fuel vapor flow to the engine 12 to stop the over fueling of the engine 12 and allow the engine speed 212 to increase.

The closed-loop control module 412 provides various commands to the closed-loop module 308 via a CL command 430. The closed-loop control module 412 reads the CL correction 250 when the trigger signal 420 is generated. When the CL correction 250 is causing richening of fueling, the closed-loop control module 412 commands the closed-loop module 308 to maintain the CL correction 250. The CL correction 250 is causing fuel richening when the CL correction 250 is greater than a predetermined non-adjusting value (e.g., 0 in the example of summing the CL correction 250 with the base EQR request 220 or 1 in the example of multiplying the CL correction 250 with the base EQR request 220).

When the trigger signal 420 is generated, the correction disabling module 416 generates a disable fuel enrichment command 434 to disable of one, more than one, or all of the fueling corrections that are richening fueling. For example, the correction disabling module 416 may command the fueling corrections 232 and 228 and/or one or more other commanded fueling enrichments to be set to the predetermined non-adjusting value when the trigger signal 420 is generated. The modules generating the respective fueling corrections (e.g., the first and second fuel correction modules 226 and 230) may set the corrections to the predetermined non-adjusting value in response to the disable fuel enrichment command 434.

The closed-loop control module 412 commands the closed-loop module 308 to maintain (i.e., leave unchanged) the CL correction 250 until a (cumulative) mass of air that has been drawn into the cylinders after the trigger signal 420 is generated is greater than a predetermined mass. The predetermined mass of air may be calibratable and may be set, for example, based on a maximum mass of air that could be within the intake manifold 24. The closed-loop control module 412 may determine the (cumulative) mass of air that has been drawn into the cylinders, for example, by integrating the MAF into the engine 12 at a predetermined rate and summing the resulting values determined after the trigger signal 420 is generated. While the example of maintaining the CL correction 250 until the (cumulative) mass of air is greater than the predetermined mass has been provided, the closed-loop control module 412 may command maintenance of the CL correction 250 for a predetermined period in various implementations.

Once the (cumulative) mass of air that has been drawn into the cylinders is greater than the predetermined mass, the closed-loop control module 412 commands the closed-loop module 308 to decrease the CL correction 250 toward the predetermined non-adjusting value at a predetermined rate. The closed-loop control module 412 ends the maintenance of the CL correction 250 or the decreasing of the CL correction 250 when at least one of: the CL correction 250 is equal to the predetermined non-adjusting value; and the US EGO sensor indicates that fueling of the engine 12 is fuel lean. The closed-loop module 308 can then return to determining the CL correction 250, as described above in conjunction with FIG. 3. The US EGO error 318 may be used to indicate whether fueling of the engine 12 is fuel lean. For example, fueling of the engine 12 may be fuel lean when a polarity of the US EGO error 318 indicates that the US EGO sample 322 is greater than (i.e., more oxygen rich than) the expected US EGO 314 or when the US EGO sample 322 indicates more oxygen than stoichiometry.

When at least one of (i) the CL correction 250 is equal to the predetermined non-adjusting value and (ii) the US EGO sensor indicates that fueling of the engine 12 is fuel lean, while the engine speed 212, the MAF 330, and an elapsed time are greater than respective thresholds, the closing module 408 allows the purge control module 110 to open the purge valve 106. Additionally, the correction disabling module 416 stops generating the disable fuel enrichment command 434 when at least one of (i) the CL correction 250 is equal to the predetermined non-adjusting value and (ii) the US EGO sensor indicates that fueling of the engine 12 is fuel lean, while the engine speed 212, the MAF 330, and the elapsed time are greater than the respective thresholds. The respective modules can then adjust the fueling corrections/commands. The elapsed time may be relative to the time when the trigger signal 420 was generated.

Figure 6:
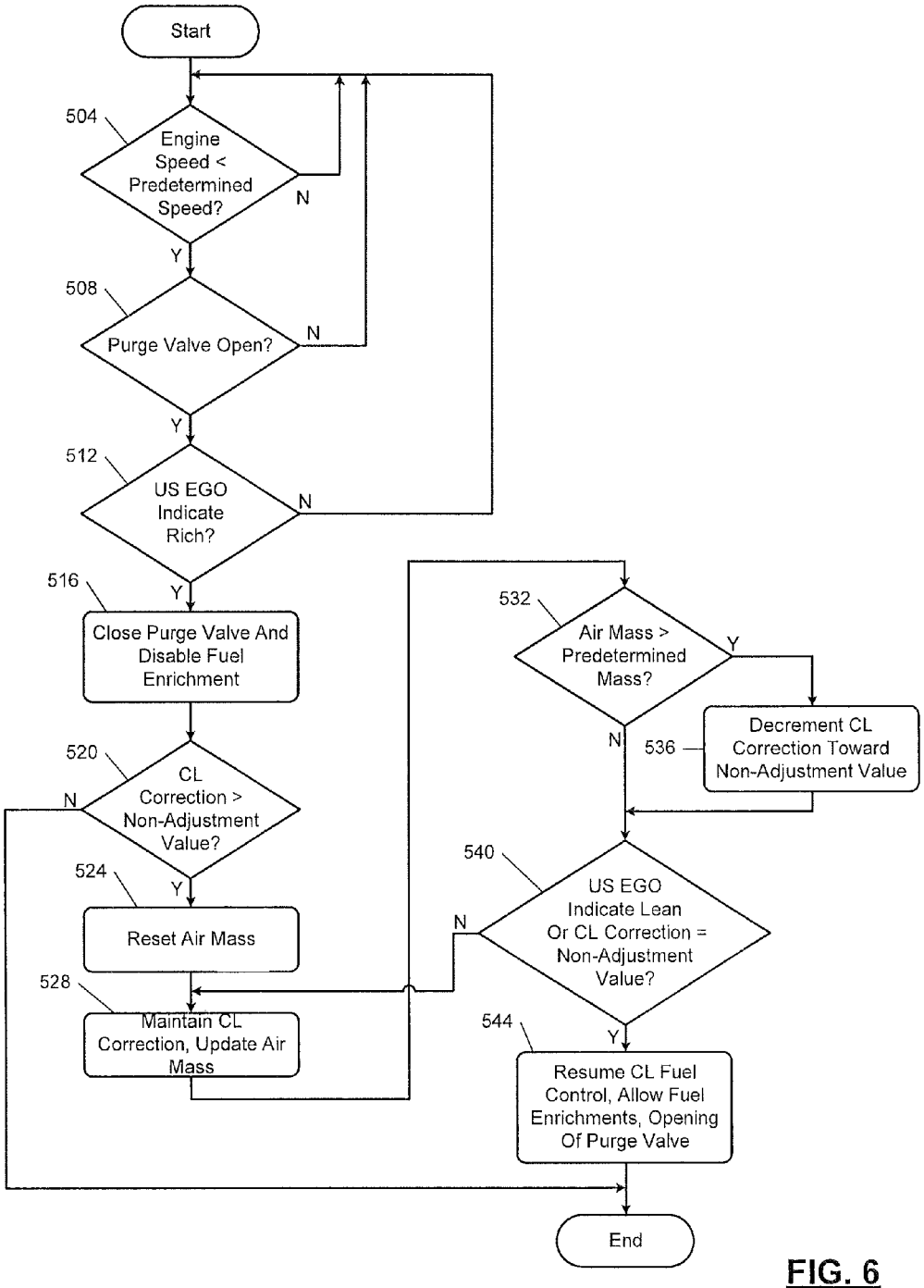
FIG. 6 is a flowchart depicting an example method of controlling fueling of the engine.

FIG. 6 is a flowchart depicting an example method of controlling fueling of the engine 12 while the vehicle/ignition system of the vehicle is ON. Control begins when the closed-loop module 308 determines the CL correction 250 as described above in conjunction with FIG. 4. At 504, the triggering module 404 determines whether the engine speed 212 is less than the predetermined speed. If 504 is true, control continues with 508. If 504 is false, control may return to 504. The predetermined speed is less than a predetermined target engine speed, such as the target idle speed of the engine 12.

At 508, the triggering module 404 determines whether the purge valve 106 is in the open state. The purge valve 106 is either in the open state or the closed state at any given time. If 508 is true, control continues with 512. If 508 is false, control may return to 504. The triggering module 404 may determine whether the US EGO sensor 38 is indicating that the fueling of the engine 12 is fuel rich at 512. If 512 is true, the triggering module 404 generates the trigger signal 420, and control continues with 516. If 512 is false, control may return to 504.

At 516, the closing module 408 generates the close command 426, and the purge control module 110 transitions the purge valve 106 to the closed state. No fuel vapor should flow through the purge valve 106 when the purge valve 106 is in the closed state. The correction disabling module 416 may also generate the disable fuel enrichment command 434 at 516. The modules generating the respective fueling corrections (e.g., the first and second fuel correction modules 226 and 230) may set the corrections to the predetermined non-adjusting value in response to the disable fuel enrichment command 434.

At 520, the closed-loop control module 412 determines whether the CL correction 250 is greater than the predetermined non-adjusting value, such as zero. The CL correction 250 is richening fueling when the CL correction 250 is greater than the predetermined non-adjusting value. If 520 is false, control may end. If 520 is true, the closed-loop control module 412 may reset a (cumulative) mass of air that has been drawn into the cylinders at 524 and continue with 528.

At 528, the closed-loop control module 412 commands the closed-loop module 308 to maintain (i.e., leave unchanged) the CL correction 520. The closed-loop control module 412 also updates the (cumulative) mass of air that has been drawn into the cylinders at 528. For example, the closed-loop control module 412 may determine a mathematical integral of the MAF into the engine 12 and sum the resulting value with the previous value of the (cumulative) mass of air.

At 532, the closed-loop control module 412 determines whether the (cumulative) mass of air that has been drawn into the cylinders is greater than the predetermined mass of air. The predetermined mass of air may be calibratable and may be set, for example, based on a maximum mass of air that could be within the intake manifold 24. If 532 is true, the closed-loop control module 412 may command the closed-loop module 308 to decrement the CL correction 250 by a predetermined value toward the predetermined non-adjustment value at 536, and control continues with 540. If a difference between the CL correction and the predetermined non-adjustment value is less than the predetermined value, the closed-loop module 308 may decrease the CL correction 250 to the predetermined non-adjustment value at 536. If 532 is false, control continues with 540.

At 540, the closed-loop control module 412 determines whether at least one of: the US EGO sensor 38 is indicating that fueling of the engine 12 is fuel lean; and the CL correction 250 is equal to the predetermined non-adjustment value. If 540 is false, the fuel control module 312 controls fueling of the next cylinder based on the CL correction 250, and control returns to 528. If 540 is true, control continues with 544. At 544, the closing module 408 stops generating the close command 426, so the purge control module 110 can then open the purge valve 106 if determined to do so. Also at 544, the closed-loop module control 412 stops generating the CL command 430, so the closed-loop module 308 can return to determining the CL correction 250, as described in conjunction with FIG. 3. Also at 544, the correction disabling module 416 stops generating the disable fuel enrichment command 434, so the respective modules (e.g., the first and second fuel correction modules 226 and 230) can adjust the fueling corrections/commands (e.g., to richen or lean fueling). While the example of FIG. 6 is shown and discussed as ending, control may return to 504.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

None of the elements recited in the claims are intended to be a means-plus-function element within the meaning of 35 U.S.C. §112(f) unless an element is expressly recited using the phrase "means for," or in the case of a method claim using the phrases "operation for" or "step for."

What is claimed is:

1. A fuel control system for an engine, comprising:

a closing module that commands closing of a purge valve in response to a last value of an engine speed measured using a sensor being greater than a predetermined speed and a present value of the engine speed being less than the predetermined speed while the purge valve is in an open state, wherein the predetermined speed is less than a predetermined target speed of the engine and is greater than zero; and a purge control module that transitions the purge valve from the open state to a closed state in response to the command.

2. The fuel control system of claim 1 wherein the predetermined target speed is a predetermined engine speed at which the engine idles.

3. The fuel control system of claim 2 wherein the predetermined speed is at least five percent less than the predetermined engine speed at which the engine idles.

4. The fuel control system of claim 1 wherein the closing module commands the closing of the purge valve in response to the engine speed transitioning from greater than the predetermined speed to less than the predetermined speed while both (i) the purge valve is in the open state and (ii) an output of an exhaust gas oxygen sensor indicates that an air/fuel mixture supplied to the engine is fuel rich relative to a target air/fuel mixture.

5. The fuel control system of claim 4 further comprising a fuel control module that periodically toggles the target air/fuel mixture between fuel rich and fuel lean and that controls fueling of the engine based on the target air/fuel mixture.

6. The fuel control system of claim 1 further comprising:

a closed-loop module that sets a closed-loop fuel correction based on an output of an exhaust gas oxygen sensor measuring oxygen in exhaust gas from the engine and that maintains the closed-loop fuel correction when the purge valve is in the open state and the engine speed transitions from greater than the predetermined speed to less than the predetermined speed; and a fuel control module that controls fuel injection of the engine based on the closed-loop fuel correction.

7. The fuel control system of claim 6 wherein the closed-loop module maintains the closed-loop fuel correction until at least a predetermined mass of air has entered the engine.

8. The fuel control system of claim 7 wherein the closed-loop module increases the closed-loop fuel correction toward a predetermined value at a predetermined rate after the maintaining of the closed-loop fuel correction.

9. The fuel control system of claim 6 wherein the closed-loop module maintains the closed-loop fuel correction until the output of the exhaust gas oxygen sensor indicates that an air/fuel mixture supplied to the engine is fuel lean relative to a target air/fuel mixture.

10. The fuel control system of claim 6 wherein the closed-loop module maintains the closed-loop fuel correction for a predetermined period when the purge valve is in the open state and the engine speed becomes less than the predetermined speed.

11. The fuel control system of claim 1 further comprising:

a fuel correction module that generates a fueling correction and that selectively increases the fueling correction; and a fuel control module that richens fueling of the engine based on the increase in the fueling correction, wherein the fuel correction module sets the fueling correction to a predetermined value when the purge valve is in the open state and the engine speed transitions from greater than the predetermined speed to less than the predetermined speed, and the fuel control module that does not richen fueling of the engine based on the fueling correction when the fueling correction is set to the predetermined value.

12. A method of controlling fueling of an engine, comprising:

commanding closing of a purge valve in response to a last value of an engine speed being greater than a predetermined speed and a present value of the engine speed being less than the predetermined speed while the purge valve is in an open state, wherein the predetermined speed is less than a predetermined target speed of the engine and is greater than zero; and transitioning the purge valve from the open state to a closed state in response to the command.

13. The method of claim 12 wherein the predetermined target speed is a predetermined engine speed at which the engine idles.

14. The method of claim 13 wherein the predetermined speed is at least five percent less than the predetermined engine speed at which the engine idles.

15. The method of claim 12 wherein the commanding closing of the purge valve comprises commanding the closing of the purge valve in response to the engine speed transitioning from greater than the predetermined speed to less than the predetermined speed while both (i) the purge valve is in the open state and (ii) an output of an exhaust gas oxygen sensor indicates that an air/fuel mixture supplied to the engine is fuel rich relative to a target air/fuel mixture.

16. The method of claim 15 further comprising:

periodically toggling the target air/fuel mixture between fuel rich and fuel lean; and controlling fueling of the engine based on the target air/fuel mixture.

17. The method of claim 12 further comprising:

setting a closed-loop fuel correction based on an output of an exhaust gas oxygen sensor measuring oxygen in exhaust gas from the engine;

maintaining the closed-loop fuel correction when the purge valve is in the open state and the engine speed transitions from greater than the predetermined speed to less than the predetermined speed; and controlling fuel injection of the engine based on the closed-loop fuel correction.

18. The method of claim 17 wherein the maintaining the closed-loop fuel correction comprises maintaining the closed-loop fuel correction until at least a predetermined mass of air has entered the engine.

19. The method of claim 18 further comprising increasing the closed-loop fuel correction toward a predetermined value at a predetermined rate after the maintaining of the closed-loop fuel correction.

20. The method of claim 17 wherein the maintaining the closed-loop fuel correction comprises maintaining the closed-loop fuel correction until the output of the exhaust gas oxygen sensor indicates that an air/fuel mixture supplied to the engine is fuel lean relative to a target air/fuel mixture.

21. The method of claim 17 wherein the maintaining the closed-loop fuel correction comprises maintaining the closed-loop fuel correction for a predetermined period when the purge valve is in the open state and the engine speed becomes less than the predetermined speed.

22. The method of claim 12 further comprising:

generating a fueling correction;

selectively increasing the fueling correction;

richening fueling of the engine based on the increase in the fueling correction;

setting the fueling correction to a predetermined value when the purge valve is in the open state and the engine speed transitions from greater than the predetermined speed to less than the predetermined speed; and not richening fueling of the engine based on the fueling correction when the fueling correction is set to the predetermined value.

* * * * *